US009232868B2

(12) United States Patent
Schiavone

(10) Patent No.: US 9,232,868 B2
(45) Date of Patent: Jan. 12, 2016

(54) CONTAINER FOR DRINKING DRINKS

(71) Applicant: CHALICE S.R.L., Citta' Sant'angelo (IT)

(72) Inventor: Moris Schiavone, Silvi Marina (IT)

(73) Assignee: Chalice S.R.L., Citta' Sant'Angelo (IT)

( * ) Notice: Subject to any disclaimer, the term of this patent is extended or adjusted under 35 U.S.C. 154(b) by 0 days.

(21) Appl. No.: 14/365,117

(22) PCT Filed: Nov. 23, 2012

(86) PCT No.: PCT/IB2012/056666

§ 371 (c)(1),
(2) Date: Jun. 13, 2014

(87) PCT Pub. No.: WO2013/088286

PCT Pub. Date: Jun. 20, 2013

(65) Prior Publication Data

US 2014/0299601 A1 Oct. 9, 2014

(30) Foreign Application Priority Data

Dec. 15, 2011 (IT) ..... BO2011A0722

(51) Int. Cl.

| | |
|---|---|
| ***A47G 19/22*** | (2006.01) |
| ***B65B 31/02*** | (2006.01) |
| ***B65D 1/16*** | (2006.01) |

(Continued)

(52) U.S. Cl.

CPC ..... *A47G 19/2272* (2013.01); *A47G 19/2205* (2013.01); *B65B 31/025* (2013.01); *B65D 1/16* (2013.01); *B65D 43/0229* (2013.01); *B65B 7/2828* (2013.01); *B65D 2543/00092* (2013.01);

(Continued)

(58) Field of Classification Search

CPC ..... B65D 13/02; B65D 1/16; B65D 43/0229; B65D 43/0225; A47G 19/2266; A47G 19/2205; A47G 19/2272; B65B 31/025; B65B 31/027; B65B 7/2828; B65B 7/28

USPC ..... 220/288, 293, 304, 711, 802, 801, 800, 220/799, 789, 784, 630, 628; 215/329, 316, 215/360, 358, 355; D7/538, 537, 509; D9/436, 435, 454

See application file for complete search history.

(56) References Cited

U.S. PATENT DOCUMENTS

| | | | | |
|---|---|---|---|---|
| 1,793,048 | A * | 2/1931 | Brigel | 215/277 |
| 2,649,090 | A * | 8/1953 | Parsons et al. | 604/415 |

(Continued)

FOREIGN PATENT DOCUMENTS

| | | |
|---|---|---|
| CN | 2374503 Y | 4/2000 |
| DE | 298 07 960 | 10/1998 |

(Continued)

OTHER PUBLICATIONS

Translation of DE 202004015220 (Kunde), Apr. 7, 2005, Paragraph 2.*

(Continued)

*Primary Examiner* — Robert J Hicks

(74) *Attorney, Agent, or Firm* — Wegman, Hessler & Vanderburg

(57) ABSTRACT

A container (1) for drinking drinks is equipped with a body (2) made of shatterproof material and comprising a broad opening (3) for forming a glass, a goblet or a tankard the container has a lid (7) which can be removably associated with the opening (3) and with the base (4) of the container (1) through a threaded coupling.

14 Claims, 4 Drawing Sheets

(51) Int. Cl.
*B65D 43/02* (2006.01)
*B65B 7/28* (2006.01)

(52) U.S. Cl.
CPC ..... *B65D 2543/00296* (2013.01); *B65D 2543/00509* (2013.01); *B65D 2543/00546* (2013.01)

(56) References Cited

U.S. PATENT DOCUMENTS

| | | | | | |
|---|---|---|---|---|---|
| 3,635,234 | A | * | 1/1972 | Dawson | 137/68.25 |
| 4,872,569 | A | * | 10/1989 | Bolte | 215/12.1 |
| 5,065,880 | A | * | 11/1991 | Horner | 220/711 |
| 5,501,363 | A | * | 3/1996 | Muller et al. | 220/630 |
| 7,140,504 | B1 | | 11/2006 | Baron | |
| 2009/0199472 | A1 | * | 8/2009 | Ito | 47/65.6 |

FOREIGN PATENT DOCUMENTS

| | | |
|---|---|---|
| DE | 20 2004 015220 | 3/2005 |
| DE | 20 2011 101525 | 7/2011 |
| GB | 444 421 | 3/1936 |
| NL | 2 002 404 | 7/2010 |
| WO | 2008/020301 | 2/2008 |

OTHER PUBLICATIONS

International Search Report and Written Opinion dated Jul. 9, 2013 for corresponding International Patent Application No. PCT/IB2012/056666.

* cited by examiner

E
1
2
3
4
5
6
7
8
9
10
12
13
14
15
16
17
161
162
701

B
C
D
F
2
3
4
5
6
8
14
15
16
161
162
201

CONTAINER FOR DRINKING DRINKS

TECHNICAL FIELD

This invention relates to a container for drinking drinks.

BACKGROUND ART

There are basically two types of containers for drinks: containers designed to preserve the drink, which are basically bottles, and containers designed to help people to drink the drink.

Containers of this latter type have a shape designed to facilitate the act of drinking a specific drink or a type of drink.

Therefore, such containers for drinking may have various shapes depending on the drink they are intended to contain. For example there are goblets in various shapes for wine, tankards for beer and, in general, glasses in various shapes for water or other drinks.

In any case, containers for drinking share the fact that they have a broad opening, unlike bottles which have a neck and a narrow opening.

Obviously, it is also possible to drink from a bottle, but, in this case, drinking is awkward, because the mouth of the drinker is forced into an unnatural position and, in many circumstances, drinking from a bottle is perceived as showing bad manners.

Another difference between containers for drinking and those for preserving drinks is the fact that, normally, containers for drinking are not made to be closed, whilst bottles are always capped or corked.

However, in some circumstances it may be useful to have available containers for drinking which are provided with a lid, so as to combine the need to transport the drink with the need to easily drink it from the container best suited to the drink.

With regard to that, patent document EP2256040 describes an apparatus for making a glass (in particular a goblet) filled with wine and closed using a film. In particular, a perimetric edge of the film is made to adhere to the edge of the opening of the glass. Said film is provided with a tab to promote removal of the film by pulling. Said glass is made of shatterproof material, so that it can be transported without the risk of breaking.

However, said solution also has several disadvantages.

First, said container can easily be transported only until it has been opened, that is to say, until the film has been removed.

In fact, once the container has been opened it cannot be closed again and, therefore, the entire drink must be consumed.

Moreover, after removal of the film, the edge of the opening remains tacky, creating an unpleasant sensation for the drinker.

Another disadvantage is the fact that the closing film may break. For example, if the container is transported in a bag which also holds keys or other objects which may tear the film.

Finally, when the film is removed, it is a waste item that must be disposed of. That is potentially inconvenient if the person does not have a pocket to put it in and wants to avoid throwing it down on the ground.

DISCLOSURE OF THE INVENTION

The aim of this invention is to provide a container for drinking drinks, together with an apparatus and a related method for closing said container, which overcome the above-mentioned disadvantages of the prior art.

It should be noticed that said container may also be used for solid or semi-liquid products (for example puddings or yoghurt) or for other food products which contain a solid part and a liquid part.

In particular, this invention has for an aim to provide a container for drinking drinks which can be easily transported even after partly consuming the contents.

Another aim of this invention is to provide a container for drinking drinks which allows drinking in a particularly convenient and enjoyable way.

Another aim of this invention is to provide a container for drinking drinks which is particularly practical to use.

These aims are fulfilled by the container according to this invention as characterised in the appended claims.

In particular, the container according to the invention is a container for drinking drinks, equipped with a body made of shatterproof material comprising a broad opening for forming a glass, a goblet or a tankard.

According to the invention, the container comprises a lid which can be screwed to the body in order to close it by means of a threaded coupling.

That allows the container to be opened and closed as many times as required. In that way, the person can partly consume the drink, then close the container again and transport it without any risk of spilling the contents, then subsequently open it again at any time.

Preferably, the thread present on the body (for forming a threaded coupling between the body and the lid) is made on the inner surface of the body.

Advantageously, that means that the lips of the person drinking from the container do not make contact with a threaded surface, thereby avoiding an unpleasant effect.

The thread may be made in such a way that it is continuous or only on limited portions of the surface of the body. In other words, the inner surface of the glass on which the thread is made may be interrupted at one or more zones (defined by corresponding arcs of a circle) which are thread-free.

That further promotes the outflow of the liquid during drinking.

Preferably, said portions of thread are highlighted (so that they are easy to identify) by an inscription on the outer surface of the container body.

Moreover, preferably, the base of the container comprises a threaded zone which can be coupled with the lid.

That allows the lid to be stably but removably associated with the base of the container, meaning that the person does not have to hold the lid in his hand while drinking, or worry about finding somewhere to put down the lid. In particular, the container preferably comprises:

- a thread (continuous or discontinuous) made on an inner surface of the container body (preferably at a predetermined distance from the edge of the opening);
- a matching thread made on an outer lateral surface of the lid;
- a thread (continuous or discontinuous) made on an inner surface formed by an annular projection extending from the base of the container body, away from the opening and comprising, on its inner surface, a thread matching the thread made on the outer surface of the lid (to allow the lid to be coupled by screwing both to the container opening and to the annular projection extending from the base of the container).

It should be noticed that the glass according to the invention is not just particularly easy to use (since the lid can easily be coupled with the base of the glass) but is also particularly hygienic. In fact, the lid is removably couplable with the base of the container in such a way that the threaded portion of the lid (designed for coupling with the opening by screwing) is contained in a recess formed by the base. Therefore, the part of the lid which makes contact with the drink is protected from possible contamination even when the lid is associated with the glass.

Therefore, the lid can be (at least partly) inserted in a recess formed by the base of the glass and coupled with the glass there. Said coupling may be produced using a thread or pressure.

Preferably, the wall of the base of the glass forming the recess comprises at least one hole or passage designed to put the recess in communication with the outside, on the side of said wall facing towards the opening.

If the base is directly connected to the body (for example in the case of a beer glass with no stem), said at least one through hole has an inlet on an annular projection of the base and an outlet on a surface of the base facing towards the lateral wall of the body.

That is advantageous when washing the glass (for example during product packaging), during which the glass is turned upside down and the recess fills with washing liquid. Advantageously, said liquid flows out through said holes.

In light of this the thread made in the base of the glass (where present) is only made on limited portions of an annular surface of said base. In other words, the annular base surface of the glass on which the thread is made is interrupted by one or more zones (defined by corresponding arcs of a circle) which are thread-free. That further promotes the outflow of the liquid (preferably through said holes).

Another problem dealt with by the invention is that of preventing the liquid contained in the container from leaking out through the closed lid.

For that purpose, there are several systems for preventing the lid, when coupled with the container, from deforming and allowing the liquid contained in the glass to leak out.

Said problem is particularly significant if the lid comprises a first disk-shaped portion and a second, annular portion extending from the first portion.

That lid shape is particularly advantageous because it allows the amount of material used for the lid to be minimised (thereby reducing the weight and cost of the container).

In light of this, for example the lid may comprise stiffening ribs, positioned on the disk-shaped portion inside the annular projection and connected to the latter to prevent it from bending inwards, therefore giving the lid greater stiffness.

In fact, when the lid is screwed to the opening of the glass, said annular projection of the lid tends to bend inwards.

Alternatively or in addition, the part of the body of the glass immediately below the thread inside the body (at the opening) is thicker than the threaded end and forms a stop for the end edge of the annular projection of the lid.

Preferably, the surface forming the stop is set at an angle to the threaded surface of the wall, so that it forms an acute angle with it.

Said angle also allows normal outflow of the liquid when the glass is tilted during drinking.

Alternatively or in addition, a thin layer of silicone may be applied to the lower end of the annular projection of the lid, thus forming a soft seal in contact with the stop point of the glass when the lid is screwed to the opening of the glass.

This invention also provides an apparatus and a method for closing the above-mentioned container, by associating the lid with the body.

The apparatus according to the invention comprises:

- a unit able to move from a raised position, in which it does not interfere with the body of the container (which is filled with the drink and is resting on a bottom), and a lowered position, in which it forms a closed chamber containing the container opening;
- a first and a second duct which are in communication with the chamber for extracting gas from the chamber (creating a vacuum) and for introducing a filling gas into it;
- a manipulator movably connected to the mobile unit and designed to grip and hold the lid and to screw it onto the body of the container.

That allows the container filled with the drink to be closed, creating a controlled atmosphere in the closed container, optimised for preserving the drink.

Preferably, the mobile unit is designed to create a seal (when it is in the lowered position) on the outer lateral wall of the container body.

That allows the stroke of the mobile unit and the chamber volume to be limited, making the apparatus particularly simple and efficient.

Preferably, the mobile unit comprises a variable-diameter sealing element (for example using a seal which can be inflated and deflated). That allows a seal to be formed on the outer lateral wall of containers having any shape (even flared or conical).

Similarly, the invention also provides a method for closing the above-mentioned container.

According to the invention, the method comprises the following steps:

- positioning the mobile unit in a position in which it does not interfere with the container body;
- feeding the lid to the manipulator designed to grip and hold the lid;
- positioning the container body, filled with a drink, in a closed chamber surrounding the container opening;
- extracting gas from the chamber and introducing a filling gas into the chamber;
- screwing the lid onto the container body, using the mobile unit in the chamber.

BRIEF DESCRIPTION OF THE DRAWINGS

These and other features of the invention will become more apparent from the following detailed description of a preferred, non-limiting embodiment of it, with reference to the accompanying drawings, in which.

Figures 1, 2, 2A, 2B, 2C:
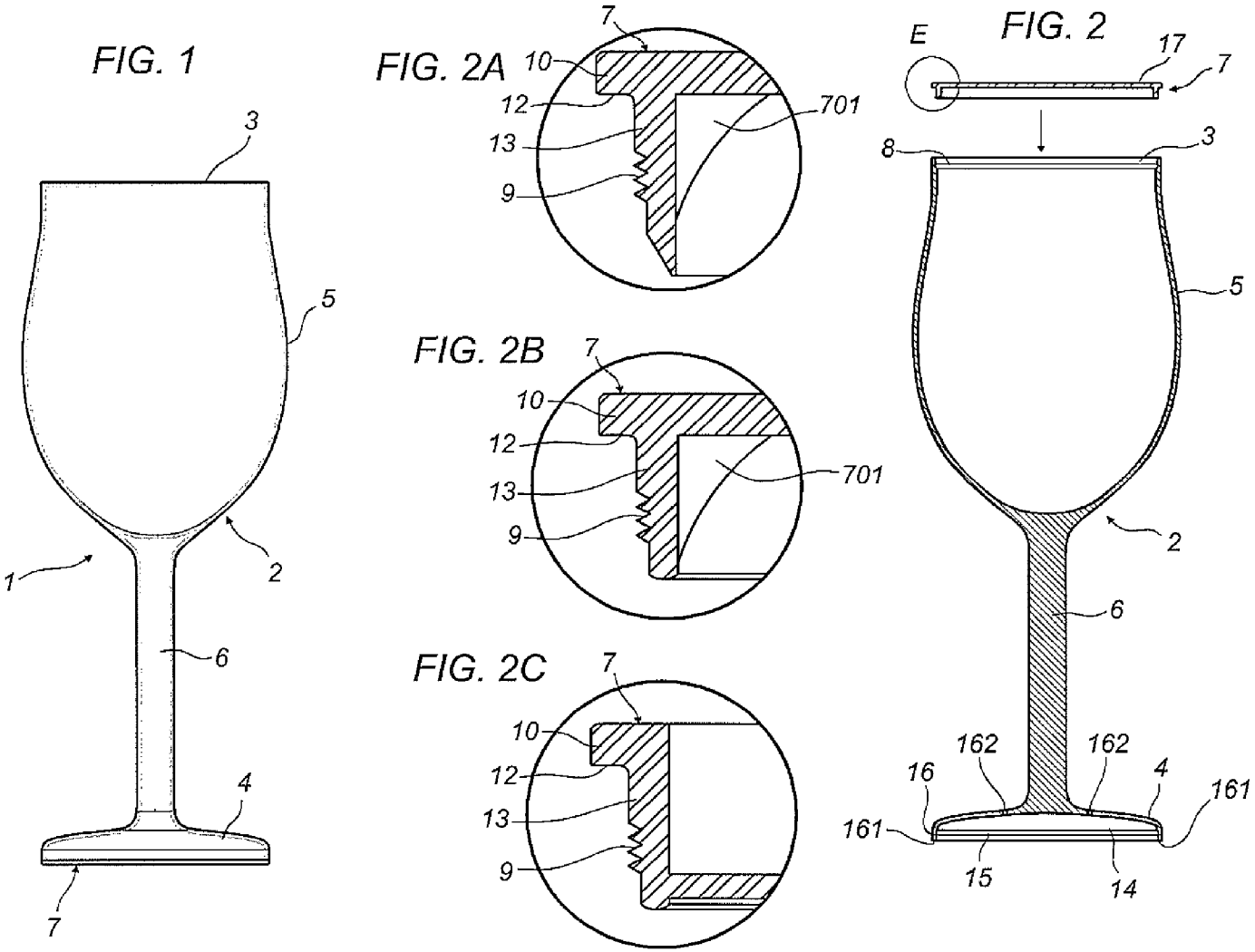
FIG. 1 is a side view with the lid coupled with the base of the container body, of a container according to this invention.
FIG. 2 is a cross-section of the container of FIG. 1, open, with the lid positioned above the container body.
FIG. 2A shows the detail of the container lid labelled E in FIG. 2.
FIG. 2B shows an alternative embodiment of the detail of FIG. 2A.
FIG. 2C shows an alternative embodiment of the detail of FIG. 2A.
Figure 5:
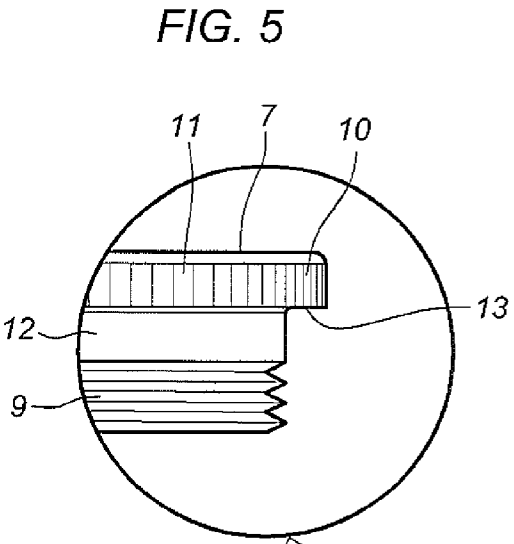
FIG. 5 shows the detail of the lid labelled A in FIG. 4.
Figure 4:
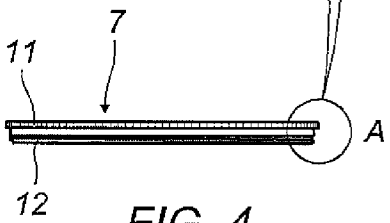
FIG. 4 is a side view of the container lid of FIG. 1.
Figure 3:
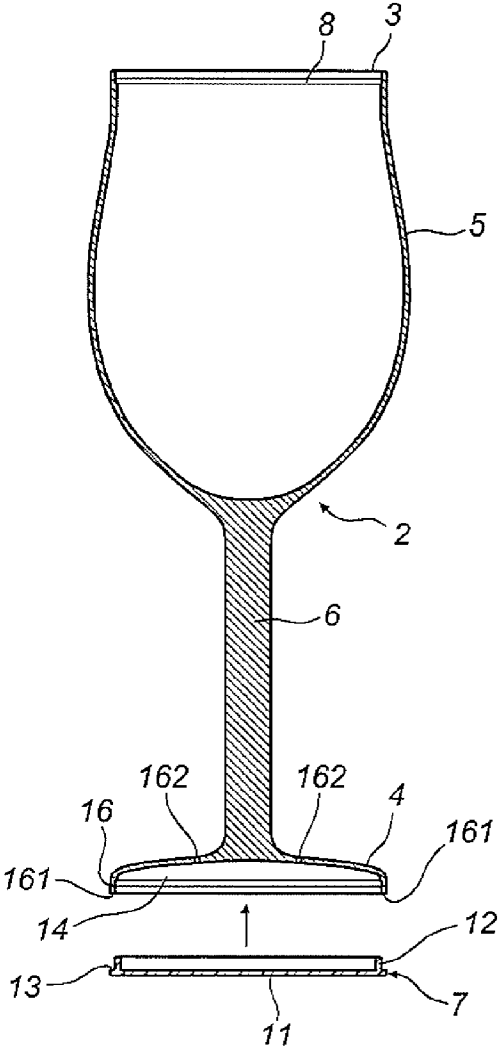
FIG. 3 is a cross-section of the container of FIG. 1, open, with the lid positioned below the container body.

The numeral 1 in the accompanying drawings denotes a container for drinking a drink.

DETAILED DESCRIPTION OF THE PREFERRED EMBODIMENTS OF THE INVENTION

Said container 1 is equipped with a body 2 shaped in such a way as to make it particularly easy for a person to drink a drink.

The body 2 is made of shatterproof material, preferably Plexiglas, PET or another organic and recyclable material.

The body 2 comprises a broad opening 3 for forming a glass, a goblet or a tankard.

The term broad opening refers to an opening whose diameter is substantially greater than or equal to an average diameter of a portion of the body 2 designed to contain the drink.

In other words, the body 2 does not narrow at the opening 3, that is to say, it has no neck (whilst a neck, or narrowing, is typical of bottles, that is to say, of containers intended for preserving and transporting drinks).

The body 2 also comprises a base 4, that is to say, a base wall, opposite to the opening 3 and a lateral wall 5 which defines the space which can be filled with the drink.

In the example illustrated, the body 2 of the container 1 is a goblet (that is to say, its shape is particularly suitable for drinking wine).

The goblet has a stem 6, connecting the lateral wall 5 to the base 4.

According to the invention, the body 2 may have other shapes, suitable for containing other drinks (for example beer). In any case, said body 2 has an opening 3 and a base 5.

According to the invention, the container 1 comprises a lid 7 which can be removably associated with the opening 3 by means of a threaded coupling.

Therefore, a thread 8 is made on the body 2 (close to the opening 3) and a matching thread 9 is made on the lid 7, in such a way that the lid 7 can be screwed onto and unscrewed from the body 2, closing and opening the opening 3.

Preferably, the thread 8 is made on the body 2 close to the opening 3 and is made on an inner surface (of the lateral wall) of the container 1 body 2.

Said thread 8 is made at a predetermined distance from the edge of the opening (preferably 3-6 mm).

Preferably, the threads 8, 9 have between 2 and 6 steps, more preferably 3 steps (for making the operation to close and open the container 1 rapid and secure).

That advantageously prevents the lips of the drinker from making contact with the thread 8 during drinking.

In light of this, it should be noticed that, preferably, an outer surface (of the lateral wall) of the body 2 close to the opening 3 is free of threads.

Moreover, said matching thread 9 of the lid 7 is made on an outer lateral surface of the lid 7, so that it can be coupled with the thread 8 when the lid 7 is at least partly inserted in the body 2.

Preferably, the lid 7 comprises a knurled or rough outer lateral surface 10, to make it easy for the person to grip during lid 7 screwing onto and unscrewing from the body 2.

Preferably, the lid 7 comprises a first portion 11 and a second portion 12, the second portion 12 having a smaller cross-section than the first portion 11.

Said (matching) thread 9 of the lid 7 is preferably formed on the lateral surface of the second portion 12 of the lid 7. Said second portion 12 of the lid 7 is shaped in such a way that it can be inserted in the body 2 through the opening 3. In light of this, preferably, the external diameter of the second portion 12 of the lid 7 is substantially equal to the internal diameter of the body 2 opening 3.

Preferably, the first portion 11 of the lid 7 forms an annular surface 13 (parallel with a plane of extension of the lid 7) shaped in such a way that it makes contact with an upper edge of the body opening 3 when the lid 7 is screwed onto the body 2.

Preferably, the diameter of the upper part 17 of the portion 11 of the lid 7 is slightly greater than the external diameter of the lateral wall 5 of the body 2 and of the annular projection 16 extending from the base 4 of the body 2, in such a way that it can be easily held onto when the lid 7 is unscrewed from the body 2.

Preferably, said knurled outer lateral surface 10 is formed on the lateral wall of the first portion 11 of the lid 7.

Preferably, the lid can be removably associated with the base 4 of the body 2 by means of a threaded coupling.

Preferably, the base 4 of the body 2 forms a housing 14 (that is to say, a recess) in which at least a portion of the lid 7 can be inserted.

In the example illustrated, said housing 14 is designed to receive the second portion 12 of the lid 7.

In light of this, preferably, the external diameter of the second portion 12 of the lid 7 is substantially equal to the internal diameter of the housing 14 of the base 4.

Preferably, a further thread 15 is made on the body 2, forming a threaded coupling with the lid 7.

Preferably, said further thread 15 is made on an inner surface (that is to say, facing towards an axis of extension of the container, also substantially constituting a cylindrical axis of symmetry of the container 1) formed by an annular projection 16 extending from the base 4 of the body 2, away from the opening 3.

The housing 14 is formed on the inside of said annular projection 16.

When the lid 7 is screwed to the base 4 of the body 2, a flat face 17 of the lid 7 (of the first portion 11 of the lid 7) forms the surface on which the container rests.

Therefore, the thread 15 of the base 4 of the body 2 is shaped in such a way as to form a threaded coupling with the thread 9 of the lid 7.

Preferably, the lid 7 is a rigid disk.

Preferably, the lid 7 is transparent.

Preferably, on the lid 7 there is an image or a text, in such a way that, when the lid 7 is screwed to the base 4 of the body 2 and the person is drinking, the person sees said image or text which is also seen by others who look at the base of the container.

Preferably, the body 2 and the lid 7 are made of the same material (PET, Plexiglas or other light, shatterproof materials) and are preferably both transparent.

Preferably, on the surface 17 of the lid 7 a label is applied which bears information about the product contained in the container 1.

Preferably, the label has at least one end which descends from the upper face 17 of the lid 7 laterally onto the portion 11 of the lid 7 and is partly superposed on the lateral wall 5 of the body 2.

In that way, the integrity of the label is a guarantee of the contents.

In fact, the part of the label superposed on the lateral wall 5 is torn when the container 1 is opened for the first time by unscrewing the lid 7.

Therefore, preferably, on its upper part 17 the lid 7 has a label bearing information about the contents of the container.

Preferably, the label has a part extending over the edge of the lid and adhering to the lateral wall 5 of the body 4, when the lid 7 is screwed to the opening 3 of the body 2 (and has never been unscrewed).

Therefore, the invention provides a product which is a container for drinking a drink, filled with said drink and closed by means of a removable lid 7.

In the preferred embodiment illustrated, the body 2 is a goblet and the drink is wine.

The lid 7 (that is to say, the second portion 12 of the lid 7) can be removably coupled with the annular projection 16 of the base 4 (which forms a recess).

Alternatively to the threaded coupling described above, the lid 7 may be coupled with the annular projection 16 of the base 4 using pressure (or by slotting into it).

The recess 14 formed by the base 4 is shaped in such a way as to house at least the second portion 12 of the lid 7.

The base 4 has dimensions greater than those of the lid, and the recess 14 is shaped in such a way as to completely house the lid 7 (the whole lid 7).

Alternatively, the recess 14 formed by the base 4 is shaped in such a way as to house at least only the second portion 12 of the lid 7, whilst when the lid 7 is coupled with the base 4 the first portion 11 projects below the body 2 and forms the base on which the container 1 rests.

In the latter case, preferably, the base 4 is shaped in such a way that the annular surface 13 of the first portion 11 of the lid 7 can abut against a corresponding annular surface 161 formed by the lower portion of the annular projection 16 (extending from the base 4 of the body 2).

It should be noticed that, preferably, the second portion 12 of the lid 7 is an annular projection extending from the first portion 11. Moreover, the second portion 12 can be inserted (with a perfect fit) in the opening 3 of the container 1.

Preferably, the base 4 comprises at least one through hole 162 (more preferably a plurality of through holes 162 or apertures).

Said hole 162 has an inlet in (open, that is to say, giving onto) the recess 14 and an outlet on (open, that is to say, giving onto) a surface of the base 4 facing towards the opening 3.

Preferably, the recess 14 is funnel-shaped, to facilitate the outflow of liquid from the recess through the holes 162, when the container is placed upside down.

Preferably, the lid 7 comprises one or more stiffening ribs which are connected to an inner surface of the annular projection of the second portion 12 of the lid 7 (the ribs being designed to prevent the second portion 12 from bending inwards).

Said stiffening ribs comprise for example a plurality of partitions 701. Preferably, the body 2 comprises at least one portion which is thicker than the portion forming the thread 8 and positioned below said thread 8.

Said thicker portion of the body 2 forms a contact surface 201, forming a stop against which an end edge of the second portion 12 of the lid 7 abuts when the lid 7 is screwed to the opening 3.

The thicker portion of the body 2 and in particular the surface 201 is made in various shapes. Several alternative embodiments are illustrated.

Figures 6, 7, 7A, 7B, 7C, 8, 8A:
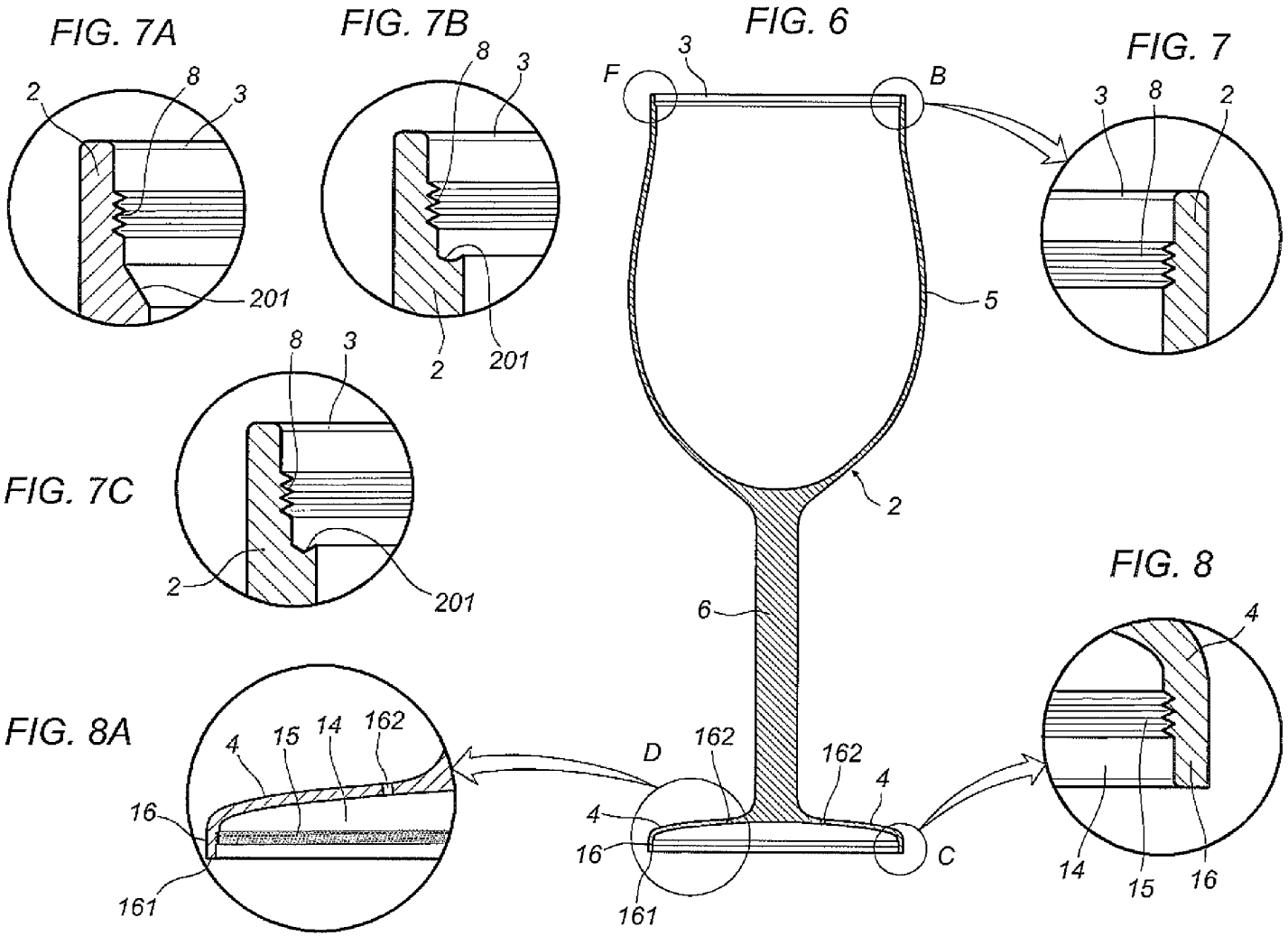
FIG. 6 is a cross-section without the lid of the container of FIG. 1.
FIG. 7 shows the detail of the container body labelled B in FIG. 6.
FIG. 7A shows an alternative embodiment to that of FIG. 7, of the detail of the container body labelled F in FIG. 6.
FIG. 7B shows an alternative embodiment of the detail of FIG. 7A.
FIG. 7C shows an alternative embodiment of the detail of FIG. 7A.
FIG. 8 shows the detail of the container body labelled C in FIG. 6.
FIG. 8A shows the detail of the container body labelled D in FIG. 6.

For example, the surface 201 may be angled to form a bevel (connecting the thicker portion and the thinner threaded end portion). That shape is illustrated in FIG. 7A.

In this case, the annular end edge of the lid 7 (that is to say, of the second portion 12 of the lid 7) is preferably angled, that is to say, bevelled (as shown in FIG. 2A), so that it abuts against the surface 201 of the body 2. Alternatively, the surface 201 may be positioned substantially perpendicularly to the lateral wall of the body 2.

In this case, preferably the surface 201 is "U-shaped" (FIG. 7B) or "V-shaped" (FIG. 7C) with the concavity facing towards the container opening 3.

Moreover, in this case, the annular end edge of the lid 7 (that is to say, of the second portion 12 of the lid 7) is preferably rounded, that is to say, "U-shaped" with the convexity facing outwards (as shown in FIG. 2B), for abutting against the surface 201 of the body 2, making contact with it at least at one or two points.

Moreover, again to prevent the risk of the lid 7 bending inwards and consequent loss of seal, there is a further alternative embodiment of the lid, of which an example is shown in FIG. 2C.

In that alternative embodiment, the disk-shaped first portion 11 of the lid 7 comprises two elements: a first element connected to the annular second portion 12 at the male-female screw coupling end of the thread 8 of the lid 7 and a second element which is a flat annular portion connected to the end of the second portion 10 opposite to said male-female screw coupling end of the thread 8. Said alternative embodiment makes the presence of the partitions 701 superfluous.

For all of the preceding alternative embodiments listed and in combination with them, it is possible to apply to the lower annular end edge of the lid 7 (that is to say, of the second portion 12 of the lid 7) a thin layer of silicone or another material with similar mechanical properties, allowing a perfect seal on the contact surface 201 of the body 2, constituting the stop, against which it abuts when screwed to the opening 3.

This invention also provides an apparatus 18 for closing the container 1 described above.

According to the invention, the apparatus 18 comprises a unit 19 able to move between a raised position, in which it does not interfere with the body 2 of the container 1 resting on a bottom 20, and a lowered position, in which it forms a closed chamber 21 containing the opening 3 of the container 1 body 2.

The mobile unit 19 forms an aperture designed to surround the container body 2.

The bottom 20 is a supporting surface, for example a conveyor belt or part of a carrousel.

The mobile unit 19 comprises a seal 21 designed to form a seal on the container body 2 or on the bottom 20.

The mobile unit 19 comprises a first duct 23 and a second duct 24 which are in communication with the chamber.

The first duct 23 is connected to a vacuum pump, for extracting gas from the chamber. The second duct 24 is connected to a tank (not illustrated) containing a predetermined filling gas and to a pump (not illustrated) for introducing said filling gas into the chamber 21.

Moreover, the apparatus 18 comprises a manipulator 25 movably connected to the mobile unit 19 and designed to grip and hold the lid 7 and to screw it onto the body 2 of the container located in the chamber 21. For example, the manipulator 25 comprises a rotary shaft 26 connected to a drive unit (not illustrated) and a suction cup 27 (connected to suction means) which is connected to the rotary shaft 26.

Preferably, the suction cup 27 is connected to the rotary shaft 26 by means of a rod 28 which can extend from and be retracted into the rotary shaft 26 in the direction of movement of the mobile unit 19 (that is to say, along the axis of the container positioned in the chamber 21, its own base 20 resting on the bottom 20).

Preferably, the seal (that is to say, the sealing element) of the mobile unit 19 is annular and is positioned on an end edge of an aperture of the mobile unit 19. The seal 22 is preferably facing towards the inside of the chamber 21.

Preferably, the sealing element (the seal 22) can be inflated and deflated to form a variable diameter.

Figure 9:
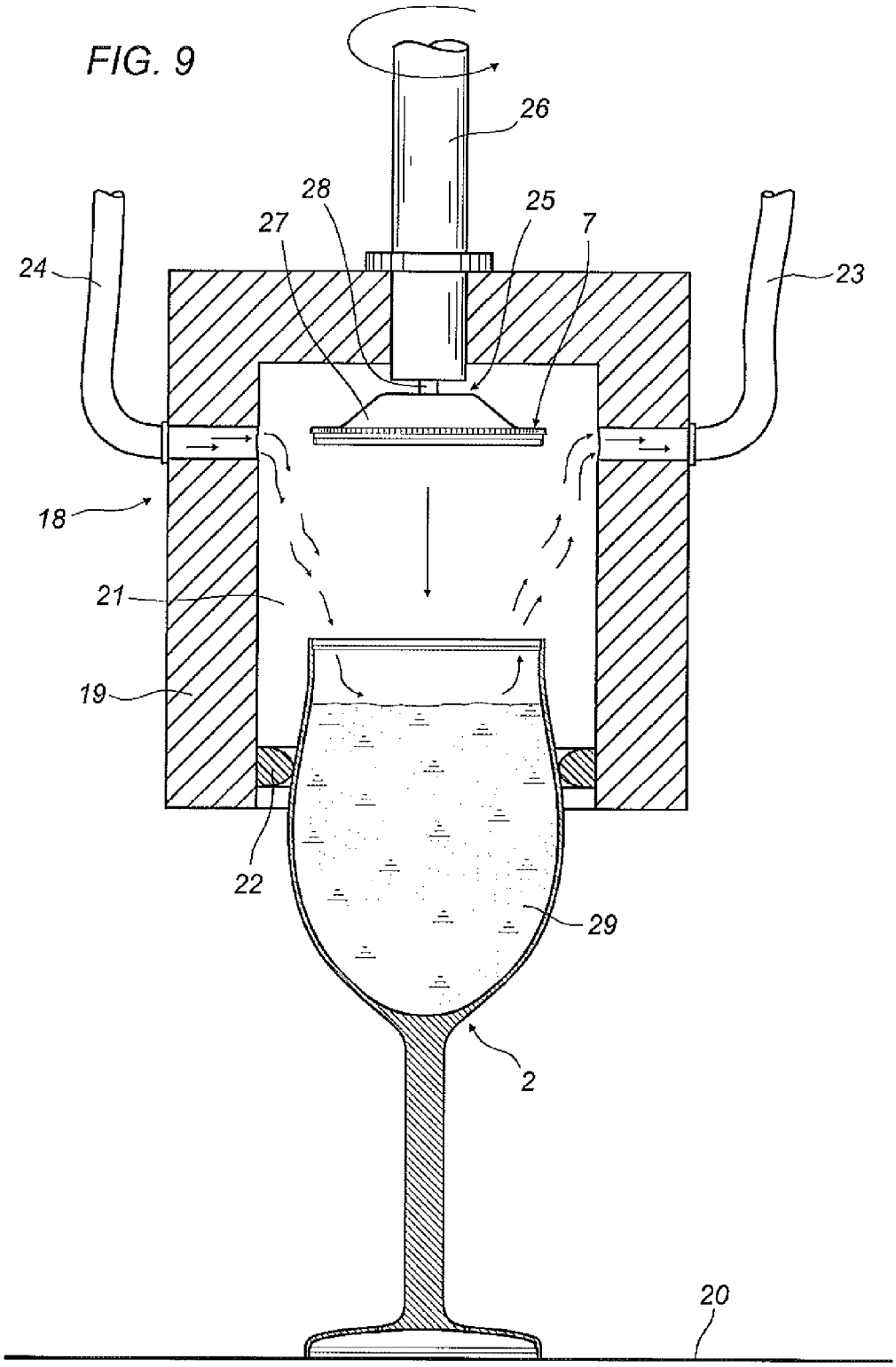
FIG. 9 shows an apparatus according to the invention, for closing the container of FIG. 1.

In FIG. 9, the body 2 is a goblet filled with wine 29.

Preferably, the filling gas is an inert gas or a gas with low oxygen content. This invention also provides a method for closing the container 1 described above.

According to the invention, the method comprises the following steps:

positioning the body 2 of the container 1, the body 2 being filled with a drink, in the closed chamber 21 surrounding the opening 3 of the body 2 of the container 1; the base 4 of the body 2 resting on the bottom 20;

extracting gas from the chamber 21 and introducing a filling gas into the chamber 21;

screwing the lid 7 onto the container body (to close the opening 3), while the container (body 2 and lid 7) is in the chamber 21.

The positioning step comprises a downward movement of the mobile unit 19, until it surrounds the opening 3 of the body 2 for enclosing it in the closed chamber 21.

To form the closed chamber 21, the seal 22 of the mobile unit 19 preferably forms a seal on the lateral wall 5 of the body 2, on the outside of it (alternatively, the seal 22 of the mobile unit 19 forms a seal on the bottom 20).

There are also steps of expanding and shrinking the seal 22 (for example by blowing air in or removing air inside the seal 22, which is made of an elastically deformable material), so as to vary the diameter of the seal.

The invention claimed is:

1. A container for drinking drinks, equipped with a body made of shatterproof material comprising a broad opening for forming a glass, a goblet or a tankard, comprising:

a lid which can be removably associated with the opening by means of a threaded coupling;

a thread made on an inner surface of the container body, at a predetermined distance from an edge of the opening;

a matching thread made on an outer lateral surface of the lid, wherein the lid comprises a first portion and a second portion having a smaller cross-section than the first portion and insertable in the opening, the matching thread being formed on the lateral surface of the second portion of the lid, wherein a base of the body of the container has an annular projection extending from said base away from the opening to form a housing, wherein the annular projection has an inner surface delimiting said housing and an outer surface, wherein an external diameter of the second portion of the lid corresponds to the diameter of the inner surface of the annular projection, whereby the housing is designed to receive the second portion of the lid, whereby said thread made on the lateral surface of the second portion of the lid is in contact to the inner surface of the annular projection, when the lid is coupled to the housing, wherein the inner surface of the annular projection of the bottom of the container is threaded to match the matching thread formed on the lateral surface of the second Portion of the lid.

2. The container according to claim 1, wherein an outer surface of the body close to the opening is free of threads.

3. The container according to claim 1, wherein the body is a goblet filled with wine or a cup for food filled with fruit and the lid is screwed onto the body.

4. The container according to claim 1, wherein said annular projection forms a recess in which at least said threaded portion of the lid can be inserted by means of pressure.

5. The container according to claim 1, wherein the base comprises at least one through hole, comprising an inlet in said recess and an outlet on a surface of the base facing towards the opening.

6. The container according to claim 4, wherein the recess is funnel-shaped.

7. The container according to claim 1, wherein the second portion of the lid is an annular projection extending from the first portion.

8. The container according to claim 7, wherein the lid comprises one or more stiffening ribs connected to an inner surface of the annular projection of the second portion of the lid to prevent the lid from bending inwards.

9. The container according to claim 7, wherein the body comprises a thread made on the inner surface of the body of the container and at least one portion which is thicker than the portion forming the thread and positioned below said thread, for forming a stop for an end edge of the second portion of the lid when the lid is screwed to the opening.

10. The container according to claim 1, wherein the body comprises a thread close to the opening, made only on limited portions of the inner surface of the body of the container, forming arcs of a circle without threads.

11. The container according to claim 10, wherein the lateral wall of the body bears at least one indication on its outer side close to the opening, indicating where to drink, positioned at said arcs of a circle without threads.

12. The container according to claim 1, wherein the body comprises a thread made only on limited portions of the inner surface of the base of the body of the container, forming arcs of a circle without threads.

13. The container according to claim 1, wherein a free annular lower end of the second portion of the lid is covered with silicone or another material forming a seal.

14. The container according to claim 1, wherein the lid has a maximum diameter which is greater than the outer diameter of the opening of the container body.

* * * * *